United States Patent [19]

Balchunas

[11] 4,109,136

[45] Aug. 22, 1978

[54] THERMOSTAT CONTROLLED FLATIRON

[75] Inventor: Charles A. Balchunas, Alta Loma, Calif.

[73] Assignee: General Electric Company, Bridgeport, Conn.

[21] Appl. No.: 765,641

[22] Filed: Feb. 4, 1977

[51] Int. Cl.[2] ..... D06F 75/26; H05B 1/02; H01H 37/12

[52] U.S. Cl. ..... 219/252; 38/82; 38/90; 74/10.9; 219/253; 219/515; 337/360; 337/368

[58] Field of Search ..... 219/245–259, 219/510, 449, 450, 512, 513, 515; 38/82, 88–90, 77.1–77.9; 337/318, 319, 334, 343, 347, 349, 360, 361, 368, 374, 375, 392; 74/10 R, 10.9

[56] References Cited

U.S. PATENT DOCUMENTS

| | | | |
|---|---|---|---|
| 2,184,270 | 12/1939 | Campbell | 219/252 |
| 2,398,579 | 4/1946 | Clark et al. | 38/90 X |
| 2,485,955 | 10/1949 | Busch | 219/251 |
| 2,486,352 | 10/1949 | Witzel | 219/252 |
| 2,644,874 | 7/1953 | Miller | 219/449 X |
| 2,674,133 | 4/1954 | Ireland | 219/251 X |
| 2,795,673 | 6/1957 | Schwaneke | 337/375 X |
| 3,136,080 | 6/1964 | Albrecht | 38/77.7 |
| 3,209,106 | 9/1965 | Huffman | 219/515 X |

FOREIGN PATENT DOCUMENTS

| | | | |
|---|---|---|---|
| 600,051 | 3/1948 | United Kingdom | 219/515 |

*Primary Examiner*—A. Bartis

*Attorney, Agent, or Firm*—John F. Cullen; George R. Powers; Leonard J. Platt

[57] ABSTRACT

In an electric flatiron with a soleplate and central upstanding boss and having a handle having a temperature adjusting lever in the front of the handle, an improvement is provided in the temperature regulating assembly that comprises a snap action thermostat which is supported on the boss with a substantially vertically movable adjusting screw to vary the thermostat settings. An insulated cap is provided on the top of the screw and the cap has an outer splined surface. A rod is connected at one end to the temperature adjusting lever forward of the screw for rotation by lever movement for setting temperature. The rod has an offset portion at its other end loosely fitting in a driving engagement over the splined surface so the offset slides vertically over the splined surface forming a universal-like connection as the rod is rotated by the lever to turn the screw and vary the thermostat setting of the iron without undue backlash.

5 Claims, 2 Drawing Figures

THERMOSTAT CONTROLLED FLATIRON

BACKGROUND OF THE INVENTION

1. Field of the Invention

The invention relates particularly to an electric flatiron that uses a soleplate mounted snap-action thermostat with a substantially vertically movable adjusting screw to vary the settings. With a forward upper handle temperature setting lever forward of the thermostat, a rod connects at one end of the lever and connects at the other end in a different universal-like connection to adjust the thermostat.

2. Description of the Prior Art

Electric flatirons have generally been provided with thermostats usually mounted in close proximity to or on the soleplate for good heat conduction and usually employ a bimetal-type thermostat. Normally the thermostat adjustment is in the forward upper part of the handle and through a series of cams and rollers, the bimetal is adjusted for different temperatures. Typical structure is shown in U.S. Pat. No. 2,681,521 of common assignment where, relatively speaking, the thermostat is slow acting in its make and break cycle. Some foreign irons require the use of a snap-action thermostat for a quick make and break to reduce radio interference but such irons generally have the temperature setting lever on the saddleplate of the iron for an easy direct connection to the thermostat. The prior art does not teach the use of the temperature regulating lever high on the forward portion of the handle where it is very convenient in combination with the typical snap-action thermostat.

Accordingly, the present disclosure is directed to a combination of a high forward mounted convenient temperature setting lever in conjunction with a typical snap-action thermostat usually rearwardly of the temperature lever and employs a universal-like interconnection permitting the use of such combination.

Briefly described, the invention is directed to an electric flatiron with a soleplate and central upstanding boss and has a handle containing a temperature adjusting lever in the upper forward portion thereof which lever is pivoted in the handle. In this general arrangement, an improved temperature regulating assembly is provided comprising a snap-action thermostat that may be of the flat stacked type and is supported on the boss with a substantially vertically movable adjusting screw to vary the settings. An insulated cap of molded plastic with splines on its outer surface is connected to the top of the screw. For adjustment, a rod is connected at one end to the temperature adjusting lever usually forward of the screw whereby the rod is rotated on movement of the lever. The rod has an offset portion at its other end loosely fitting in driving engagement with the splined surface so that the offset slides vertically over the splined surface forming a universal-like connection as the rod is rotated by the lever to turn the screw and vary the thermostat setting. Thus, the main object of the invention is to provide an electric flatiron with an improved temperature regulating assembly using a snap-action thermostat which can be regulated by a horizontally movable temperature adjusting lever disposed high in the forward end of the handle.

DESCRIPTION OF THE PREFERRED EMBODIMENT

The invention will be described in connection with a steam iron although it is applicable to any electric flatiron employing various common features.

Figure 1:
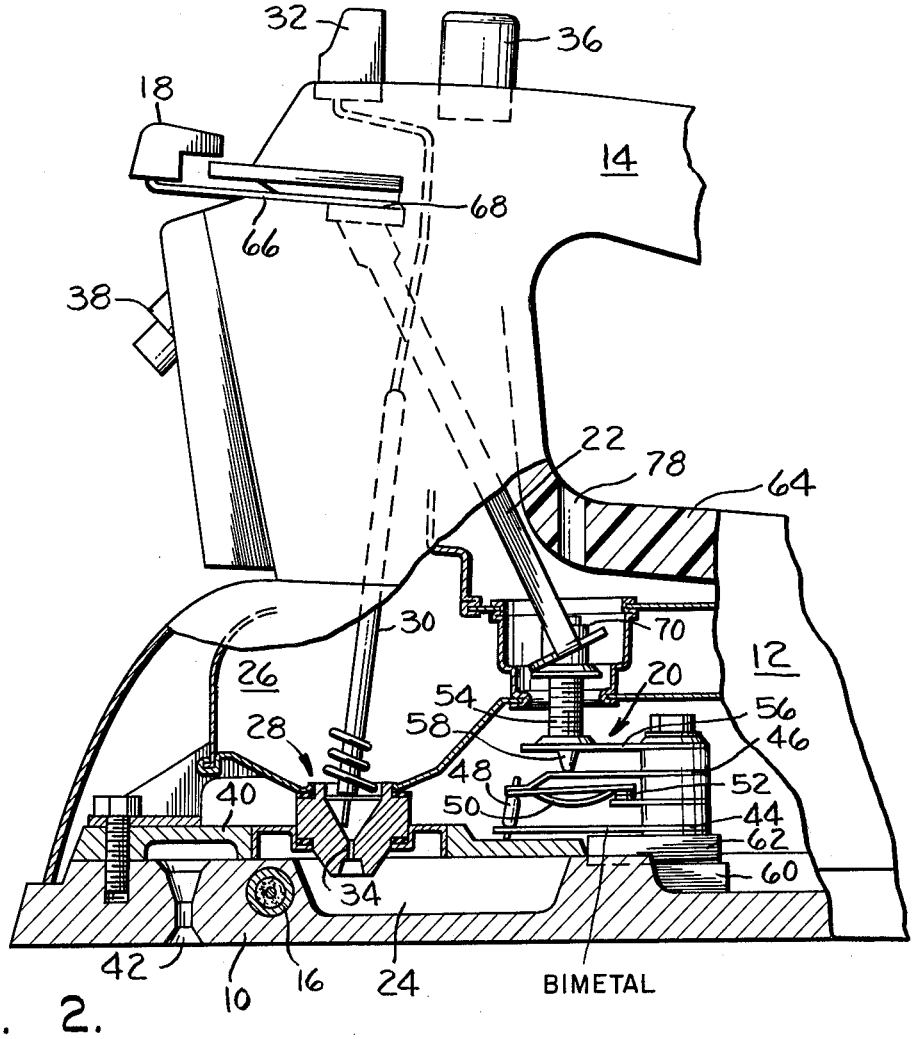
FIG. 1 is an elevational view, partially in section and phantom, showing general parts of an electric flatiron with the invention applied; and, FIG. 2 is a partial exploded perspective view of the lever cap/splined universal-like connection.

Referring to FIG. 1, a steam iron embodying the invention typically includes a soleplate 10, connected cover 12, and operating handle 14. In accordance with conventional practice, soleplate 10 may be cast from aluminum with an electrical heating element usually of the sheath type in which an electrical resistance 16 extends through a protective sheath with the heating element separated from the sheath by an insulating compound such as magnesium oxide. The entire heating element 16 is preferably cast into the soleplate. Heretofore the temperature of the soleplate was set by control knob 18 connected to operate a thermostat generally indicated at 20 through a roller/cam connection as in said '521 patent through an interconnecting rod 22 as well known in the art as in U.S. Pat. No. 2,755,574. Uniform heat is provided by extending the heating element 16 in the loop from the rear along one side of the soleplate to the forward end and then rearwardly along the other side. If the iron is a steam iron, soleplate 10 has a steam boiler 24 and a suitable water tank 26 supplies water thereto under control of metering water valve structure, generally indicated at 28, that includes a valve stem 30 suitably actuated by step button 32 through normal linkage to stop and start the metered flow of water through orifice 34 into the boiler 24 for generating flash steam in a conventional manner. If a spray feature is provided, button 36, pumps water from the tank 26 and sprays it ahead of the iron through a nozzle 38 all as well known. Steam generated in boiler 24 is distributed under coverplate 40 through suitably formed passages between the coverplate and soleplate and out ports 42. This is a typical steam/dry/spray iron and any one of the features except dry, may be omitted or others such as self-clean and/or surge may be added.

Generally, the electric flatirons have used a relatively slow make and break thermostat and the conventional roller/cam arrangement has been adequate. In accordance with some foreign requirements and/or stiffer domestic requirements, a snap-action thermostat may be used. This thermostat, per se, is well known and it makes and breaks a circuit very quickly to reduce radio and television interference for apparent reasons.

For convenience, it is customary and desirable to provide the temperature setting lever high on the forward end of the handle and swing it back and forth in a substantially flat parallel plane where it is easily adjustable and visible by the user. This has created problems with respect to the interconnection with the generally flat stacked-type snap-action thermostats with their vertical adjustments especially when, as usual, the thermostats are located aft of the temperature setting lever. While any suitable snap-action thermostats with vertically movable adjusting screws may be used, such as a disc type, a typical thermostat commonly used is the stacked-type which, for convenience, is shown and described. To this end, a typical flat stacked thermostat 20 has a bimetal blade 44 that expands and contracts on the application of heat from soleplate 10 to move blade 46 through spaced insulator 48. Through a well known stressed loop 50 a slight movement of bimetal 44 rapidly makes and breaks contacts 52 so there is a sharp "snap" on the rapid breaking of the contacts thus reducing radio and TV interference. For adjustment, a vertically rotatable adjusting screw 54 is mounted in upper fixed plate 56 and turning the screw applies or releases pressure through insulating cone 58 to change the pressure on blade 46 and hence the opening and closing force on the contacts 52. Such thermostats per se are well known and widely used and a typical one is shown in U.S. Pat. No. 3,170,998.

In order to use a common soleplate for many different versions of irons, a central upstanding boss 60 is provided on the soleplate. The thermostat 20 may be mounted directly on the boss 60 or preferably, more flexibility and adaptation to many versions of the iron is better provided, by the interposition of a flat adaptor plate 62 which is in tight abutting relation with both the thermostat and the boss for good and close heat conducting relation. While not necessary, the adaptor plate may also compensate for any imperfections in the heat joint between the thermostat and boss.

Saddleplate 64 is the usual mount for the temperature setting knob in foreign irons thus providing a direct connection between the knob and adjusting screw 54. However, in irons where the temperature adjusting lever 66 is located in a substantially horizontal plane high in the forward part of the handle to be pivoted at 68 for temperature setting, the normal roller/cam connection of the type used heretofore for slow make and break thermostats is inadequate.

Figure 2:
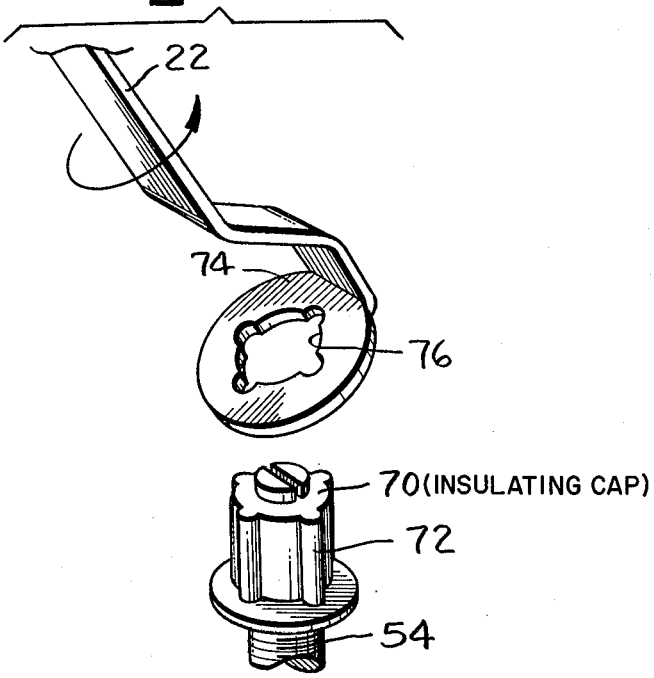

For use with the snap-action thermostat and the high forward temperature setting combination, there is provided an insulating cap 70 connected to the top of screw 54 and such cap may conveniently be a molded plastic for easy manufacture and insulation. For adjusting the screw vertically the cap is formed with an outer splined surface 72, being perferably formed with at least a pair of oppositely disposed splines as seen in FIG. 2. With the temperature setting lever 66 normally being forward of the thermostat 20, rod 22 is connected at one end to lever 66 in a conventional screwdriver/slot connection so that rod 22 rotates on movement of lever 66 exactly as in U.S. Pat. No. 2,755,754 supra. To translate the rotation to adjusting screw 54, rod 22 has an offset portion 74 at its other end which is formed with a matching opening 76 to loosely fit in driving engagment over splined surface 72 as seen in FIG. 2. A loose sliding fit is provided so that the offset 74 may slide vertically on cap 70 over splined surface 72 while, at the same time, turning the cap in a universal-like connection as rod 22 is rotated by the temperature adjusting lever 66. This then, varies the temperature setting by varying the pressure on bimetal 44. While normally not necessary since thermostats are factory preset, the offset 74 may permit access to the top of adjusting screw 54 from vertically above through an opening 78 that may be disposed below the saddleplate if desired to permit calibration of the thermostat in a conventional manner as in U.S. Pat. No. 2,892,272. Thus, the invention provides a unique interconnection of a universal-like arrangement to provide the high forward temperature adjustment through a flat horizontal plane where it is easily reached and visible by the user in combination with a rearwardly disposed snap-action thermostat that is normally adjusted by movement of a substantially vertical adjusting screw.

While I have hereinbefore shown a preferred form of the invention, obvious equivalent variations are possible in light of the above teachings. It is therefore to be understood that, within the scope of the appended claims, the invention may be practiced otherwise than as specifically described, and the claims are intended to cover such equivalent variations.

I claim:

1. In an electric flatiron having an electrically heated soleplate provided with a central upstanding boss thereon, a handle on said soleplate, said handle including a front portion located forwardly and upwardly of said boss, said handle containing a temperature adjusting lever in front portion thereof with said lever being pivoted in said handle, an improved temperature regulating assembly comprising, a snap action thermostat for regulating the temperature of said soleplate supported on said boss and having a substantially vertically movable adjusting screw to vary the thermostat settings, an insulated cap fixedly connected to the top of said screw for rotation therewith, said cap having an outer splined surface, a rod connected at one end to said lever forwardly of said screw for rotation by lever movement, said rod having an offset portion at its other end loosely fitted in driving engagement over the splined surface of said cap, said offset portion being slidable vertically over the splined surface thereby forming a universal-like connection between said rod and screw as the rod is rotated by said lever to turn said screw and vary the thermostat setting.

2. Apparatus as described in claim 1 wherein said temperature adjusting lever is movable in a flat horizontal plane across the front portion of said handle.

3. Apparatus as described in claim 2 wherein a flat adaptor plate is disposed in close heat conducting relation between said boss and thermostat.

4. Apparatus as described in claim 3 wherein said thermostat is a flat stacked-type snap action thermostat.

5. Apparatus as described in claim 4 wherein said cap is a molded plastic cap having at least a pair of splines forming said splined surface and the offset portion is formed to allow access to the adjusting screw from vertically above.

* * * * *